US005294888A

United States Patent [19]

Miyata et al.

[11] Patent Number: 5,294,888

[45] Date of Patent: Mar. 15, 1994

[54] DEVICE FOR DETECTING MISFIRE OF AN INTERNAL COMBUSTION ENGINE BY COMPARING VOLTAGE WAVEFORMS ASSOCIATED WITH IGNITION SYSTEM

[75] Inventors: Shigeru Miyata; Takashi Suzuki; Yoshihiro Matsubara, all of Nagoya; Yuuichi Shimasaki; Takashi Hisaki, both of Wako, all of Japan

[73] Assignees: NGK Spark Plug Co., Ltd., Nagoya; Honda Giken Kogyo K.K., Wako, both of Japan

[21] Appl. No.: 865,909

[22] Filed: Apr. 9, 1992

[30] Foreign Application Priority Data

Apr. 12, 1991 [JP] Japan ..... 3-080158

[51] Int. Cl.[5] ..... F02P 17/00

[52] U.S. Cl. ..... 324/393; 324/399

[58] Field of Search ..... 324/393, 399

[56] References Cited

U.S. PATENT DOCUMENTS

| | | | |
|---|---|---|---|
| 4,004,213 | 1/1977 | Kato et al. | 324/399 |
| 4,006,403 | 2/1977 | Olsen et al. | 324/399 X |
| 4,547,732 | 10/1985 | Spaude | 324/399 X |
| 5,046,470 | 9/1991 | Entenmann et al. | 324/399 X |
| 5,143,042 | 9/1992 | Scheid | 324/399 X |

*Primary Examiner*—Gerard R. Strecker
*Assistant Examiner*—Warren S. Edmonds
*Attorney, Agent, or Firm*—Cooper & Dunham

[57] ABSTRACT

In equipment for recognizing misfire in an internal combustion engine, a first voltage waveform is obtained at an intermediate point (A) between a high impedance element (41) and a low impedance element (42). The first voltage waveform has a capacitive discharge component and an inductive discharge component during the spark and a voltage component after completion of the spark. The first voltage waveform is inversely amplified by a comparator (51) and divided by a shunt circuit (52) to obtain a second voltage waveform. In an integration circuit (53), a condenser (C1) is electrically charged by an output voltage from the comparator (51) to obtain a third voltage waveform. The second voltage waveform and the third voltage are compared by a comparator (54) to generate an output pulse. On the basis of the behavior of relatively short and relatively wide output pulse (d2, D2) and additional short output pulses (d3, d4) from the comparator (54), it is determined whether or not a misfire has occurred in the internal combustion engine.

2 Claims, 2 Drawing Sheets

DEVICE FOR DETECTING MISFIRE OF AN INTERNAL COMBUSTION ENGINE BY COMPARING VOLTAGE WAVEFORMS ASSOCIATED WITH IGNITION SYSTEM

BACKGROUND OF THE INVENTION

1. Field of the Invention

This invention relates to equipment for recognizing in an internal combustion engine in which an ignition voltage is supplied to each spark plug in a prescribed order by means of a distributor.

With the demand of purifying emission gas and enhancing fuel efficiency of an internal combustion engine, it has been necessary to detect firing conditions in each cylinder of the internal combustion engine so as to protect the internal combustion engine against misfire. In order to detect the firing condition in each of the cylinders, an optical sensor has been installed within the cylinders on one hand. On the other hand, a piezoelectrical sensor has been attached to a seat pad of the spark plug.

In both of the cases, however, it is troublesome and time-consuming to install the sensor to each of the cylinders, thus increasing the installation cost, and at the same time, taking much time in checking and maintenance.

Therefore, it is an object of the invention to provide an ignition detector of spark plug for use in internal combustion engines which is capable of precisely detecting a waveform of a secondary voltage applied to the spark plug installed to each cylinder of the internal combustion engine with a relatively simple structure.

SUMMARY OF THE INVENTION

According to the invention, there is provided a misfire detector device for use in internal combustion engine comprising: a secondary circuit provided to apply voltage to a spark plug of an internal combustion engine; a secondary voltage waveform detector provided to detect a secondary voltage waveform; an integrating means provided to integrate the secondary voltage waveform detected by the secondary voltage waveform detector during a predetermined period including a part of sparking time period of the spark plug; and a comparator provided to compare the secondary voltage waveform with an integral value of the integrating means; a misfire being determined by a relationship between the integral value of the integrating means and the secondary voltage waveform based on an electrical resistance of a spark gap changing depending upon whether air-fuel mixture is normally ignited or not when the spark plug is energized.

The secondary voltage waveform is detected from the spark plug or the high tension cord connected to the secondary circuit of the ignition coil. Analyzing the waveform makes it possible to distinguish normal ignition from misfire, faulty ignition of the spark plug, and feeding the analyzed information back to a combustion control device to give a warning of worsened emission gas and deteriorated catalyst.

The misfire is detected only by analyzing the secondary voltage waveform by means of an electronic circuit, thus making it possible to mount easily with a simple structure and minimum maintenance.

These and other objects and advantages of the invention will be apparent upon reference to the following specification, attendant claims and drawings.

DETAILED DESCRIPTION OF THE EMBODIMENTS

Figure 1:
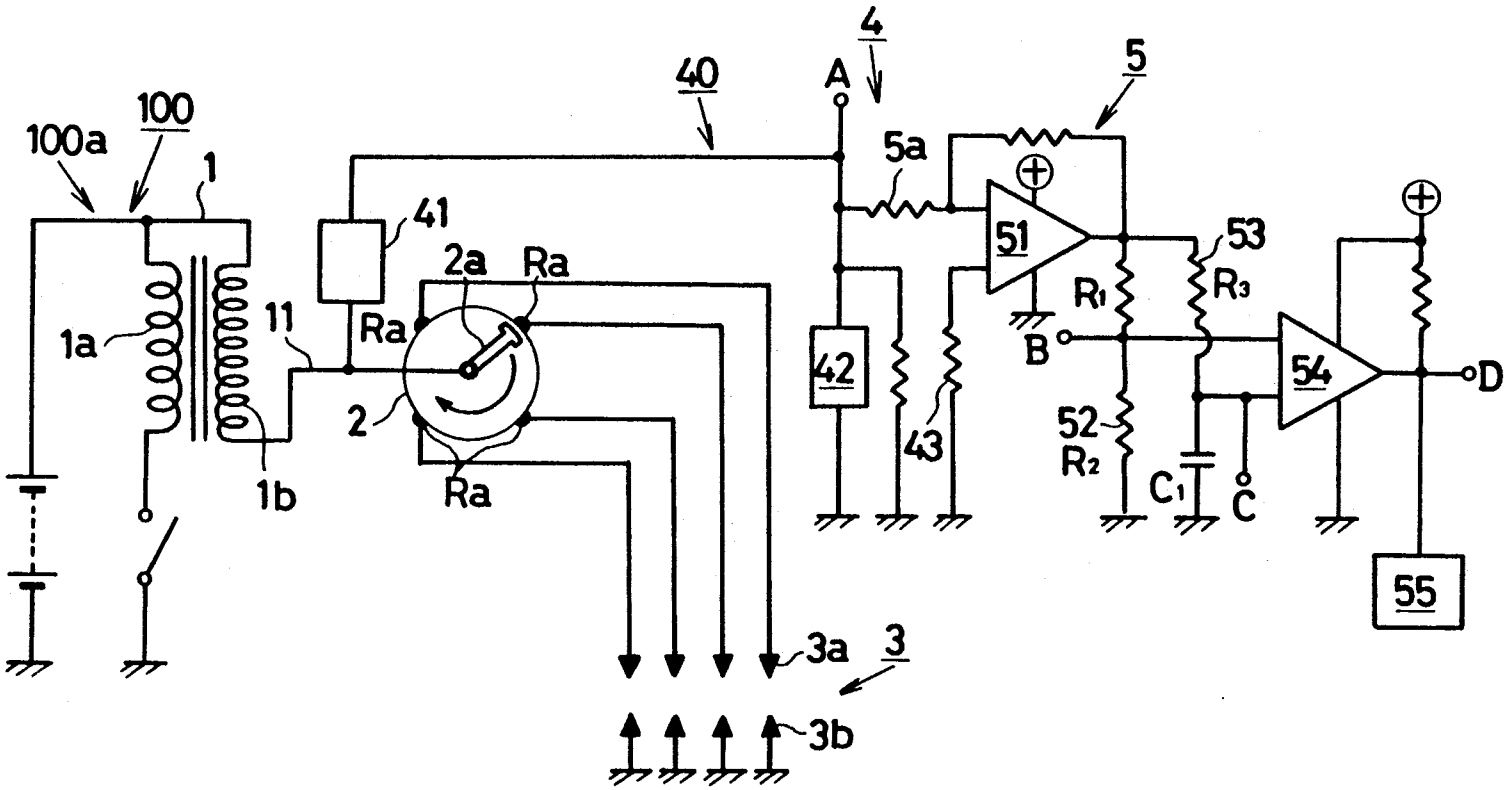
FIG. 1 is a schematic view of an ignition circuit having a secondary voltage detector circuit for an internal combustion engine.

Referring to FIG. 1, there is provided an ignition circuit 100*a* of an ignition device 100 for an internal combustion engine which includes an ignition coil 1 having a primary coil 1*a* and a secondary coil 1*b*. A high tension cord 11 has one end electrically connected to the secondary coil 1*b*, and having the other end connected to a rotor 2*a* of a distributor 2 which integrally incorporates a contact breaker (not shown) and has e.g. four stationary segments (Ra). To each of the stationary segments (Ra), a free end of the rotor 2*a* approaches to make a series gap (e.g. 0.30 mm in width) with the corresponding segments (Ra) during the rotary movement of the rotor 2*a*. To each of the four stationary segments (Ra), is a center electrode 3*a* of a spark plug 3 electrically connected which is installed in each of four cylinders of the internal combustion engine. The spark plug 3 has an outer electrode 3*b* electrically connected to the ground so that the secondary coil 1*b* energizes each of the spark plugs 3 by way of the high tension cord 11, the rotor 2*a* and each of the stationary segments (Ra) of the distributor 2.

To the high tension cord 11 which is provided to electrically connect the secondary coil 1*b* to the distributor 2, is a high impedance element 41 connected to form a secondary voltage detector 40 which includes a low impedance element 42 and an electrical resistor 43 connected in parallel with the high impedance element 41. The low impedance element 42 has one end connected to the high impedance element 41, and having the other end connected to the ground. A shunt resistor 5*a* of a misfire detection circuit 5 is connected between the low impedance element 42 and the high impedance element 41 to form a misfire detector device 4.

The secondary voltage detector is adapted to divide secondary voltage across the high tension cord 11 by the order of 1/2000 in which high voltage of about 20000 volt is reduced to the level of 10 volt since the secondary voltage is picked up in accordance with a ratio of the high impedance element 41 to the low impedance element 42. The voltage thus reduced is fed to the misfire detection circuit 5 through the shunt resistor 5*a*.

In the misfire detection circuit 5, the circuit 5 has an operational amplifier 51 and a shunt circuit 52 which comprises resistors (R1), (R2) to shunt an output from the operational amplifier 51. The circuit 5 further has an integration circuit 53 and a comparator 54. The integration circuit 53 has a resistor (R3) and a condensor C1 to calculate the output from the operational amplifier 51, while the comparator 54 compares a shunt value of the shunt circuit 52 to an integral value of the integration circuit 53.

A first voltage waveform picked up from an intermediate point (A) between the high impedance element 41 and the low impedance element 42 has a capacitive discharge component in an order of 100 amperes for 1 nanoseconds based on the breakdown of the spark gap. Following the capacitive discharge component, an inductive discharge component occurs in an order of 50 milliamperes for 1 millisecond as shown at (a) in FIG. 2 which is a voltage waveform equivalent to that of the secondary circuit directly divided in accordance with a ratio of the high impedance element 41 to that of the low impedance element 42.

The inductive discharge component, changes the secondary voltage waveform since an electrical resistance of a spark gap between the electrodes 3*a*, 3*b* varies from the case in which spark occurs between the electrodes 3*a*, 3*b*, and ignites air-fuel mixture gas in the cylinder to the case in which spark occurs between the electrodes 3*a*, 3*b*, but fails to ignite the air-fuel mixture gas.

The spark normally ignites the air-fuel mixture gas to generate combustion gas which is ionized at or around the spark gap to decrease the electrical resistance between the electrodes 3*a*, 3*b*. The decreased electrical resistance causes the capacitive discharge in the order of 100 amperes for about 1 nanosecond followed by the inductive discharge in the order of 50 milliamperes at low voltage (V1) for about 1 millisecond until all the electrical energy of the ignition coil 1 has released.

Figure 2:
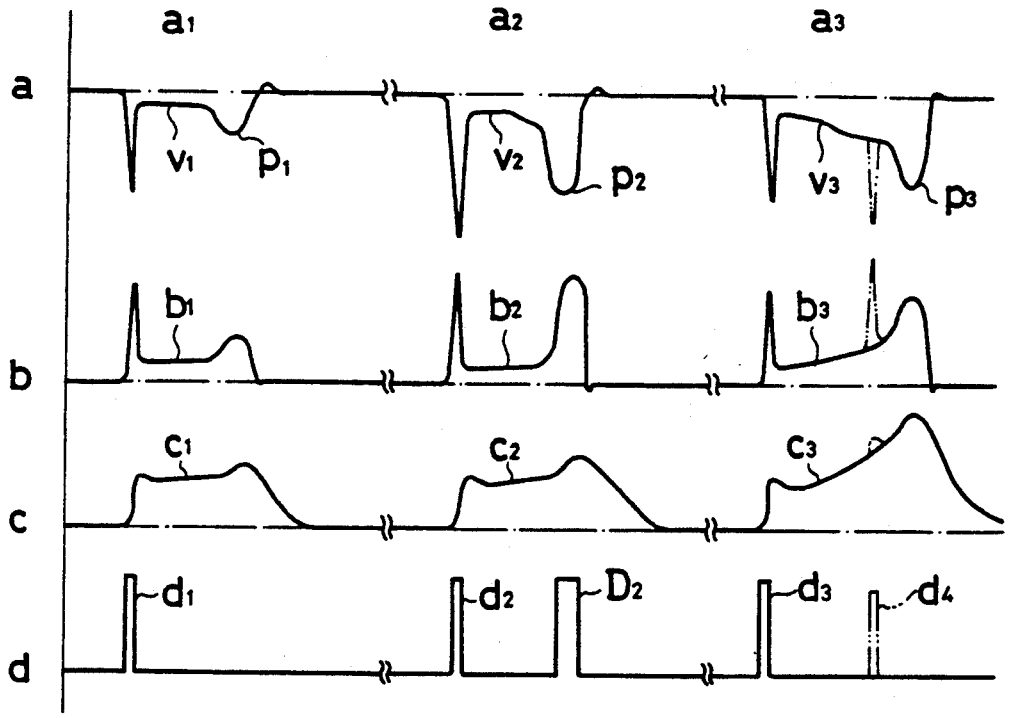
FIG. 2 shows waveforms for the purpose of explaining how the secondary voltage detector circuit works.

Completing the inductive discharge is followed by a low peak voltage (P1) as shown at (a1) in FIG. 2.

When the spark fails to ignite the air-fuel mixture gas, the electrical resistance between the electrodes 3*a*, 3*b* is greater. The greater electrical resistance terminates the inductive discharge for a short period of time to reserve a greater amount of electrical energy in the ignition coil 1. The greatly reserved energy in the ignition coil 1 completes the capacity discharge followed by the inductive discharge at low voltage (V2) and succeeding a rapidly increased peak voltage (P2) as shown at (a2) in FIG. 2.

When the spark ignites the air-fuel mixture gas, strong swirls make the spark errant to lengthen a sustaining time period of the spark. The errant spark interrupts the discharge between the electrodes 3*a*, 3*b* and destroys the insulation of the spark gap between the electrodes 3*a*, 3*b*.

In this situation, the completion of the capacity discharge followed by the inductive discharge at progressively increasing voltage (V3) and succeeding the capacity discharge again gives rise to an intermediate peak voltage (P3) after completing the discharge as shown at (a3) in FIG. 2.

The first voltage waveform picked up from the intermediate point (A) is inversely amplified by the operational amplifier 51, and is divided by the shunt circuit 52 to be fed into one terminal of the comparator 54. A second voltage waveform derived from a shunt point (B) between the operational amplifier 51 and the shunt circuit 52 is as shown at (b1), (b2) and (b3) of (b) in FIG. 2. An output from the operational amplifier 51 electrically charges a condensor (C1) by way of an electrical resistor (R1) of the integration circuit 53. A third voltage waveform derived from an intermediate point (C) between the electrical resistor (R3) and the condensor (C1) is as shown at (c) in FIG. 2.

The comparator 54 compares the second voltage waveform (b) with the third voltage waveform (c) so as to generate an output pulse (d) at an output terminal (D) of the comparator 54. The output pulse (d) is adapted to be fed into a microcomputer or a pulse-width determinant circuit 55.

When the spark normally ignites the air-fuel mixture gas, a level of an integral voltage waveform (cl) becomes lower than the capacity discharge level of the voltage waveform (b1) so as to generate a single short pulse (d1) as shown at (d) in FIG. 2.

When the spark fails to ignite the air-fuel mixture gas, each of the waveforms corresponding in turn to the capacity discharge and peak voltage (P2) in the voltage waveform (c2) exceeds the rest of the voltage waveform (c2) so as to simultaneously produce a short pulse (d2) and a wider pulse (D2) from the output terminal (D) of the comparator 54.

When the spark ignites the air-fuel mixture gas, but strong swirls make the spark errant to lengthen a sustaining time period of the spark. The errant spark either increases the inductive discharge level or induces the capacity discharge again so as to produce a higher level of an integral voltage waveform (c3) after completing the discharge. The higher level of the integral voltage waveform makes it possible to exceed the peak voltage level (P3) so as to produce either a single short pulse (d3) or short pulses (d3)~(d4) at once from the output terminal (D) of the comparator 54.

Each of the pulses (d1)-(d4) based on the capacity discharge has a very short period of cycle compared to the resonance cycle of a sparking of the spark plug. Since it is found that the cyclic period of the pulse (D2) exceeds ¼ of the resonance cycle of the spark plug when the spark fails to ignite the air-fuel mixture gas, it is possible to judge misfire by detecting the cyclic period of the pulse (D2) exceeding ¼ of the resonance cycle of the spark plug.

While the invention has been described with reference to the specific embodiments, it is understood that this description is not to be construed in a limiting sense inasmuch as various modifications and additions to the specific embodiments may be made by a skilled artisan without departing from the spirit and scope of the invention.

What is claimed is:

1. Apparatus for recognizing misfire in an internal combustion engine equipped with an ignition circuit (100*a*) having a primary coil (1*a*) and a secondary coil (1*b*), means for sending a primary current flowing through the primary coil (1*a*) to induce a secondary voltage across the secondary coil (1*v*), and a distributor (2) for applying the secondary voltage across electrodes (3*a*, 3*b*) of a spark plug (3) so as to establish a spark between the electrodes (3*a*, 3B) of the spark plug (3), comprising:

(a) a secondary voltage detector (40) electrically connected between the secondary coil of the ignition circuit and the spark plug (3) so as to detect a secondary voltage value based on a spark in which the spark plug (3) is discharged by the ignition circuit;

(b) an integration means (53) which is electrically connected to the secondary voltage detector (40) to integrate the secondary voltage value so as to produce an integration voltage;

(c) a comparator means (54) electrically connected to the secondary voltage detector (40) and the integration means (53) so as to compare the secondary voltage value with the integration voltage, and producing an output pulse when the secondary voltage value exceeds the integration voltage;

(d) a microcomputer means (55) electrically connected to the comparator means (54) to detect a width of the output pulse from the comparator means (54) so as to determine a misfire due to an abnormal ignition of an air-fuel mixture in the internal combustion engine when the width of the output pulse of the comparator means (54) exceeds a predetermined level.

2. Apparatus or recognizing misfire in an internal combustion engine as recited in claim 1, wherein a predetermined level of the width of the output pulse from the microcomputer means (55) is derived from a cyclic period of the output pulse which exceeds ¼ of a resonance cycle of the spark plug (5).

* * * * *